US010219983B2

(12) United States Patent
Zelinski

(10) Patent No.: US 10,219,983 B2
(45) Date of Patent: Mar. 5, 2019

(54) CAP SYSTEMS WITH PIERCING MEMBER FOR PHARMACEUTICAL VIALS

(71) Applicant: Genesis Packaging Technologies, Exton, PA (US)

(72) Inventor: Peter Zelinski, Milville, NJ (US)

(73) Assignee: Genesis Packaging Technologies, Exton, PA (US)

( * ) Notice: Subject to any disclaimer, the term of this patent is extended or adjusted under 35 U.S.C. 154(b) by 310 days.

(21) Appl. No.: 15/227,470

(22) Filed: Aug. 3, 2016

(65) Prior Publication Data

US 2018/0036203 A1 Feb. 8, 2018

(51) Int. Cl.
*A61J 1/14* (2006.01)
*A61J 1/20* (2006.01)

(52) U.S. Cl.
CPC ..... *A61J 1/2096* (2013.01); *A61J 1/201* (2015.05); *A61J 1/1412* (2013.01)

(58) Field of Classification Search
CPC ..... B65D 51/002; B65D 51/18; B65D 39/00; A61J 1/1412
See application file for complete search history.

(56) References Cited

U.S. PATENT DOCUMENTS

| | | | |
|---|---|---|---|
| 3,577,701 | A | 5/1971 | Bott et al. |
| 3,964,234 | A | 6/1976 | Hurst |
| 3,998,032 | A | 12/1976 | Koebbeman |
| 4,219,986 | A | 9/1980 | Osterhaus |
| 4,230,231 | A | 10/1980 | Burnett et al. |
| 4,435,942 | A | 3/1984 | Zaltsman |
| 4,511,044 | A | 4/1985 | Connor et al. |
| 4,552,278 | A | 11/1985 | Romanauskas |
| 4,614,077 | A | 9/1986 | Muto et al. |
| 5,064,083 | A | 11/1991 | Alexander et al. |
| 5,085,332 | A | 2/1992 | Gettig et al. |
| 5,314,084 | A | 5/1994 | Folta et al. |
| 5,429,256 | A | 7/1995 | Kestenbaum |
| 5,718,348 | A | 2/1998 | Manera |

(Continued)

FOREIGN PATENT DOCUMENTS

| | | |
|---|---|---|
| EP | 0909719 A1 | 4/1999 |
| EP | 2174884 A1 | 4/2010 |

OTHER PUBLICATIONS

International Search Report for PCT/US2012/030513 dated Jun. 27, 2012.

(Continued)

*Primary Examiner* — Kai H Weng
(74) *Attorney, Agent, or Firm* — Caesar Rivise, PC

(57) ABSTRACT

A cap system for sealing injectable drugs within a vial is disclosed. The system includes an elastomeric stopper, a retainer member, a locking member, a cap assembly and a piercing member. The retainer member is arranged to snap onto the vial and the locking member slid with respect to the retainer member to permanently seal the vial. The cap assembly includes a cap and a band and is coupled to the locking member. The cap releasably holds the piercing member. The band is arranged to be removed to enable the cap to move the piercing member to penetrate the stopper, whereupon the cap can be removed. The piercing member is arranged to be connected to a syringe or other instrument to withdraw the vial's contents.

16 Claims, 3 Drawing Sheets

(56) References Cited

U.S. PATENT DOCUMENTS

| | | | | |
|---|---|---|---|---|
| 5,803,284 | A | 9/1998 | Grimard | |
| 5,819,964 | A | 10/1998 | Grimard | |
| 6,158,196 | A | 12/2000 | Trebbi et al. | |
| 6,478,788 | B1 * | 11/2002 | Aneas | A61J 1/2089 215/247 |
| 6,619,499 | B1 | 9/2003 | Lin | |
| 6,792,743 | B2 | 9/2004 | Odell et al. | |
| 6,857,250 | B1 | 2/2005 | Taylor | |
| 6,874,301 | B2 | 4/2005 | Kitamoto | |
| 7,024,837 | B2 | 4/2006 | Takebe et al. | |
| 7,204,151 | B2 | 4/2007 | Kitamoto et al. | |
| 7,467,482 | B2 | 12/2008 | Yarborough et al. | |
| 8,353,145 | B2 | 1/2013 | Zanini et al. | |
| 8,544,665 | B2 | 10/2013 | Bogle et al. | |
| 8,656,688 | B2 | 2/2014 | Schonfelder et al. | |
| 8,726,619 | B2 | 5/2014 | Bogle et al. | |
| 8,789,347 | B2 | 7/2014 | Bogle et al. | |
| 2005/0022479 | A1 | 2/2005 | Kitamoto | |
| 2005/0086830 | A1 | 4/2005 | Zukor et al. | |
| 2005/0257623 | A1 | 11/2005 | Kitamoto et al. | |
| 2006/0134354 | A1 | 6/2006 | Walters et al. | |
| 2006/0287638 | A1 * | 12/2006 | Aneas | A61J 1/2096 604/411 |
| 2007/0102393 | A1 | 5/2007 | Colin et al. | |
| 2007/0272648 | A1 | 11/2007 | Hamamoto et al. | |
| 2010/0089862 | A1 | 4/2010 | Schmitt | |
| 2010/0224632 | A1 | 9/2010 | Aneas | |
| 2011/0068106 | A1 | 3/2011 | Zukor et al. | |
| 2013/0205719 | A1 | 8/2013 | Wensley et al. | |
| 2013/0240476 | A1 | 9/2013 | Aneas | |

OTHER PUBLICATIONS

International Search Report for PCT/US2013/058933 dated Dec. 20, 2013.

* cited by examiner

CAP SYSTEMS WITH PIERCING MEMBER FOR PHARMACEUTICAL VIALS

CROSS-REFERENCE TO RELATED APPLICATIONS

"Not Applicable"

STATEMENT REGARDING FEDERALLY SPONSORED RESEARCH OR DEVELOPMENT

"Not Applicable"

INCORPORATION-BY-REFERENCE OF MATERIAL SUBMITTED ON A COMPACT DISK

"Not Applicable"

FIELD OF THE INVENTION

This invention relates generally to container capping systems and more particularly to systems for capping pharmaceutical vials to provide ready access to the contents of the vials when desired.

BACKGROUND OF THE INVENTION

For more than sixty years injectable drugs have been packed in glass vials. Such vials typically are formed of glass and have a cylindrical neck terminating in a flanged top or lip, with the opening to the interior of the vial extending through the neck. The neck is sealed by means of a rubber stopper and an aluminum seal or ferrule. When these types of vials are used in lyophilization (freeze drying) the vial is filled with liquid and then the stopper (which is a complex or complicated elastomeric member) is inserted part way into the vial so that the product can be lyophilized. In this regard, the standard stopper and vial combination often rely on a feature called a "blowback" on the inside of the vial's lip to mate with an indentation on the elastomeric stopper. This action keeps the stoppers from rising up during processing. Once the lyophilization process has occurred the stopper is then fully seated in place, e.g., pushed down, so that it is completely within the neck of the vial during the final stages of the process and a ferrule applied to lock the stopper in place to thereby permanently seal the vial. Needless to say this is a complex operation and requires that the entire operation be accomplished within sterile conditions, e.g., within the freeze drying apparatus. Moreover, the construction of the closures require the use of vials having the blowback feature, thereby limiting the materials that can be used to form the vials to glass, e.g., plastic materials have not proved economically viable for producing vials with a viable blowback feature.

In U.S. Pat. No. 8,544,665 (Bogle et al.), which is assigned to the same assignee as this invention and whose disclosure is specifically incorporated by reference herein, there is disclosed and claimed a cap system for permanently sealing a pharmaceutical vial which overcomes the disadvantages of the prior art. That cap system basically comprises an elastomeric stopper, a retainer member and a locking cap member. The cap system of that patent application is particularly to be used on a conventional glass pharmaceutical vial having an interior, an opening to the interior of the vial and a flanged neck surrounding the opening, the flanged neck having an undersurface. The elastomeric stopper of the cap system has a body portion. The retainer member has a top wall and a peripheral sidewall. A plurality of resilient fingers is located about the periphery of the sidewall. The locking cap member comprises a peripheral sidewall including inwardly projecting members and is slidably coupled to the retainer member. The stopper is arranged to be secured to the vial so that its body portion partially closes the opening of the vial. The retainer member is arranged to be secured to the vial with its fingers being arranged to flex over the flanged neck of the vial and then snap into engagement with the undersurface of the flanged neck of the vial and with portions of the top wall of the retainer member in engagement with portions of the stopper to hold the stopper in place on the vial to seal the opening in the vial and prevent removal of said stopper from the vial. The locking cap member is arranged to be slidably secured over the retainer member after the retainer member has sealed the opening in the vial to lock it in a fixed position with respect to the retainer member, whereupon its inwardly projecting members apply an inward force on the fingers of the retainer member to ensure that the vial is permanently sealed.

While the cap system of the foregoing patent is eminently suitable for its intended purposes it nevertheless leaves something to be desired from the standpoint of facilitating access to the contents of the vial after the vial has been permanently sealed.

The subject invention addresses that need.

SUMMARY OF THE INVENTION

In accordance with one aspect of the invention there is provided a cap system for a pharmaceutical vial having an interior in which a flowable material is disposed, an opening to the interior of the vial and a flanged neck surrounding the opening, with the flanged neck having an undersurface. The cap system comprises an elastomeric stopper, a retainer member, a locking member, a cap member and a piercing member. The elastomeric stopper is arranged to be secured to the vial. The retainer member comprises a sidewall and a plurality of resilient fingers located about the periphery of the sidewall. The retainer member is arranged to be secured to the vial with the fingers of the retainer member being arranged to flex over the flanged neck of the vial and then snap into engagement with the undersurface of the flanged neck of the vial. The locking member is slidably coupled to the retainer member and comprises a peripheral sidewall including inwardly projecting members. The locking member is arranged slid to a fixed position with respect to the retainer member, whereupon the inwardly projecting members of the locking member apply an inward force on the fingers of the retainer member to permanently seal the vial. The cap member is coupled to the locking member and is a hollow member having a socket therein. The piercing member is releasably located in the socket and has a piercing tip.

In accordance with one preferred aspect of this invention the cap member is slidably coupled to the locking member to enable the cap member to be slid from a retracted position to an extended position wherein the piercing tip of the piercing member passes through the stopper into the interior of the vial.

In accordance with another preferred aspect of this invention the cap member comprises a portion of an assembly additionally comprising a band releasably secured to the cap member. The band is arranged to be removed from the assembly to enable the cap member to be slid from the retracted position to the extended position.

In accordance with another preferred aspect of this invention the socket includes an internally threaded portion and wherein the piercing member comprises an externally threaded portion screwed within the internally threaded portion of the socket. The cap member is arranged to be unscrewed from the piercing member after the cap member is in the extended position, whereupon the cap member can be removed from the vial leaving the piercing member in place extending into the interior of the vial.

DETAILED DESCRIPTION OF THE PREFERRED EMBODIMENT

Figure 1:
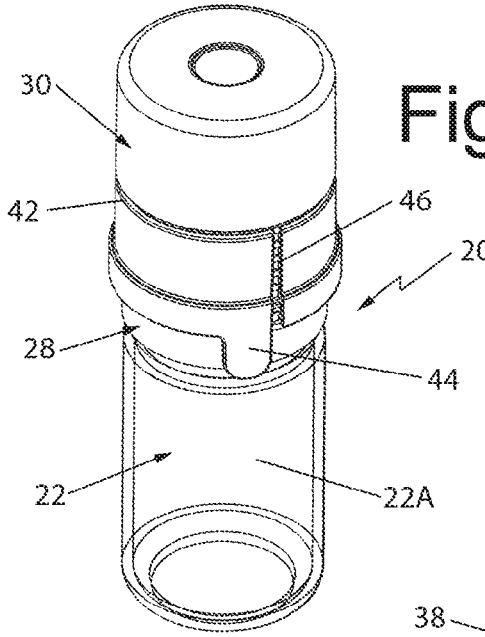
FIG. 1 is an isometric view of a conventional glass pharmaceutical vial on which one exemplary embodiment of a cap system constructed in accordance with this invention is disposed.

Referring now to the various figures of the drawing wherein like reference characters refer to like parts, there is shown in FIG. 1 one exemplary embodiment of a capping system 20 constructed in accordance with this invention for use on a conventional glass pharmaceutical vial 22, such as used for holding an injectable liquid. The capping system basically comprises basically comprises a resilient (e.g., elastomeric) stopper 24, a retainer member 26, a locking member 28, a cap assembly 30 and a piercing member 32. The details of all of those components and their operation will be described later. Suffice it for now to state that the vial 22, the stopper 24 and the retainer member 26 are all constructed and arranged like those members disclosed in FIGS. 1-6 of U.S. Pat. No. 8,544,665 (hereinafter referred to as the "'665 patent"), whose disclosure is specifically incorporated by reference herein. Thus, in the interest of brevity the many of the details of the features and operation of those components will not be reiterated.

The capping system 20 of this invention is particularly suitable for use on pharmaceuticals vial, such as a glass vial used for injectable drugs, but owing to the construction of the closure assembly it can also be used on vials made of plastic. The vial 22 basically comprises a hollow body 22A in which a pharmaceutical or other drug or other product to be held in a sterile state is located. The entrance to the interior of the vial's body is provided via an opening extending through a neck of the vial. The top of the neck of the vial is in the form of a lip or flange, having a generally planar top surface and a somewhat undercut surface. Since the retainer member 26 is constructed in accordance with the teaching of the '665 patent the interior surface of the opening in the neck of the vial need not include a blow-back annular recess, as has characterized prior art vials. Thus, the capping system of this invention enables one to use simpler vials than existing prior art glass vials. In fact, the subject invention enables one to use vials made of plastics as well.

Figure 6:
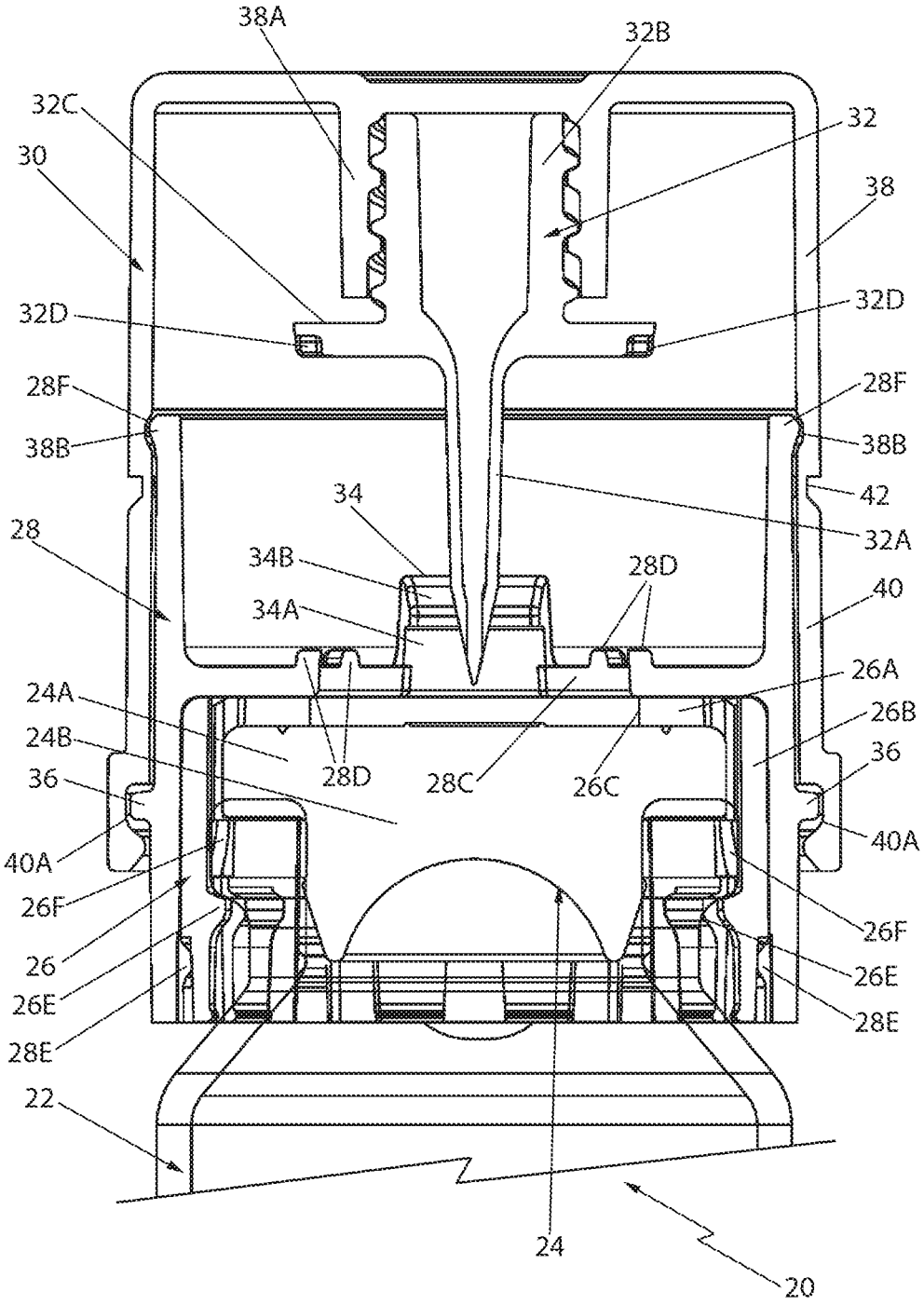
FIG. 6 is an enlarged vertical sectional view of the capping system of FIGS. 1 and 2 shown in place on the vial before the piercing member of the capping system is moved to gain access to the interior of the vial.

The resilient stopper 24 is best seen in FIG. 6 and basically comprises a disk-like body 24A from which a plug 24B projects. The outer surface of the free end of the plug is tapered to facilitate its entrance into the opening 6 in the vial. The distal surface of the plug includes a hemispherical recess to provide some give to also facilitate entry of the plug into the vial opening. The periphery of the disk-like body 22A is in the form of a flange having a generally planar undersurface. The central portion of the stopper is arranged to be pierced by a piercing tip 32A (to be described later) which is a hollow pointed structure forming a portion of the piercing member 32. The piercing member 32 is, itself, arranged to be coupled to a syringe, catheter or some other instrument (not shown) to provide access to the contents of the vial.

Figure 2:
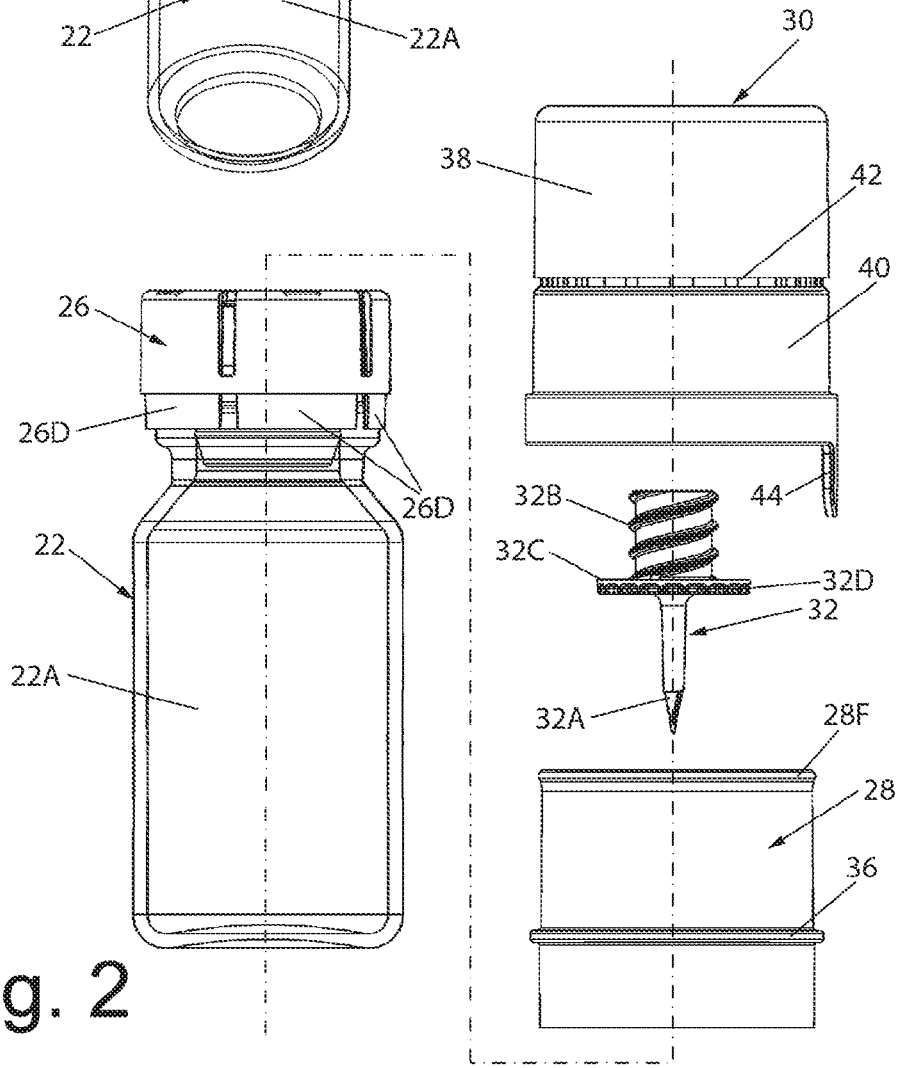
FIG. 2 is an enlarged exploded side elevation view of the vial and the cap system shown in FIG. 1.
Figure 3:
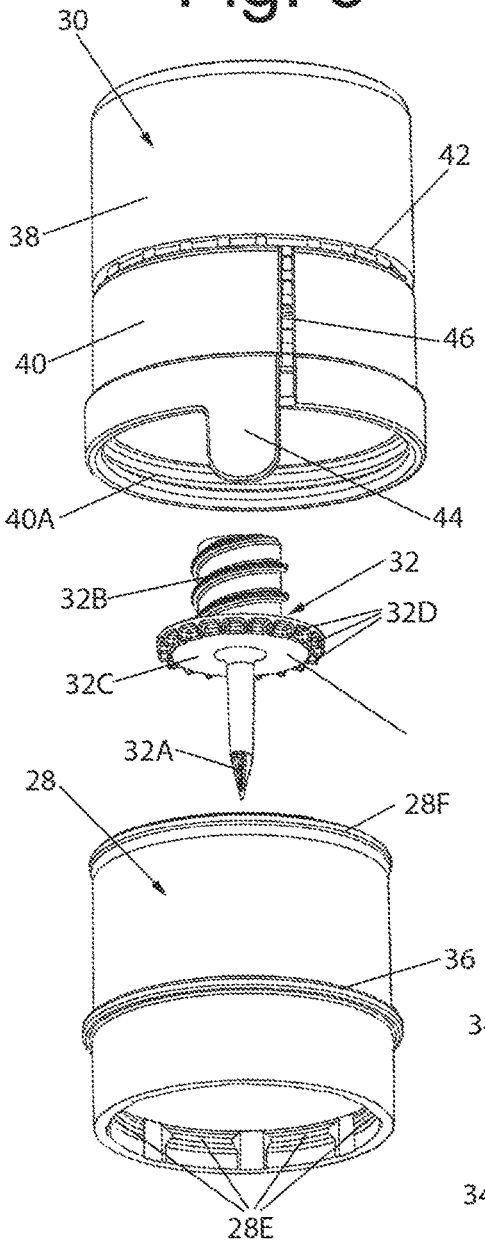
FIG. 3 is an exploded isometric view of a cap member, a piercing member and a locking member forming a portion of the cap system shown in FIGS. 1 and 2.

As best seen in FIGS. 2, 3, and 6, and as will be described in detail later, the piercing member 32 includes an externally threaded hollow portion 32B which is screwed into a threaded socket (to be described later) forming a portion of the cap assembly 30. The piercing member also includes a generally planar, circular flange 32C located between the piercing tip 30A and the threaded portion 32B. The flange 32C serves as a means for connecting the piercing member 32 to the locking member 28 when the piercing tip has pierced the stopper 24 (as will be described later). The flange 32C includes a plurality of recesses 32D (also to be described later) in its under surface contiguous with its periphery. The recesses are arranged for cooperation with plural projections or teeth (also to be described later) of the locking member to hold the flange in place on the locking member. That action will be described later.

The retainer member 26 is also best seen in FIG. 6 as well as in FIG. 2 and basically comprises a top wall 26A and a peripheral sidewall 26B. The center portion of the top wall is open, i.e., includes a hole 26C to provide access to the stopper so that the piercing tip 32A of the piercing member can be inserted therethrough. The peripheral sidewall 26B includes a plurality of slots so that the portions of the sidewall between the slots form respective, downwardly extending fingers 26D (FIG. 2). At least one (and preferably two) internal lugs 26E project inward from the inner surface of each of the fingers. Each finger also includes a flexible tab 26F extending inward and upward from the inner surface of the associated finger. The tabs are arranged to flex inward so that the stopper 24 can be inserted and held within the retainer member, with the top surface of the stopper abutting the undersurface of the top wall 26A. The tabs then snap back into place to engage the undersurface of the stopper and thereby hold the stopper in place.

The capping system 20 is arranged to be placed on the neck of a vial so that the top surface of the vial's neck abuts the inwardly projecting lugs 26E of the retainer member 26. In this position the distal end 24C of the plug portion of the stopper 26 is located within the opening of the vial and will be a slight gap or open interface between the outer surface of the distal end of the stopper and the inner surface of neck of the vial. The gap is in fluid communication with the slots between the fingers 26D and hence to the ambient atmosphere to enable the lyophilization of the pharmaceutical within the vial (as described in the '665 patent).

In order to close the interface and thus temporarily seal the vial, all that is required is to apply a downward force on the retainer member to cause its fingers 26D to flex outward to ride over the flanged lip of the neck of the vial, so that the top surface of the inwardly projecting lugs 26E snap into place to engage the undersurface of the neck of the vial. Moreover, the tabs 26F ride over and tightly engage contiguous portions of the lip of the vial. This action traps the retainer member 26 on the neck of the vial and slightly compresses, e.g., 20% compression, the peripheral flange of stopper 24 between the top wall of the retainer member and the top surface of the neck of the vial, whereupon the drug contents in the vial are sealed off from the ambient atmosphere.

The locking member 28 of this invention takes the place of the locking cap member 28 that is shown in FIGS. 12-18 of the '665 patent and is also used to permanently lock the closure assembly in place on the vial. In addition, the locking member 28 of this invention includes a portion (to be described shortly) which cooperates with the cap assembly 30 and the piercing member 32 to enable the piercing member to gain access to the contents of the vial after it has been permanently sealed when such is desired, e.g., when it is desired to withdraw all or a portion of the pharmaceutical from the vial into a syringe or other instrument.

It should be pointed out at this juncture that the entire capping system 20 can be preassembled so that the entire assembly can be placed on a vial to be sealed at one time (although the sealing steps are carried out sequentially as described in the '665 patent). Alternatively, the locking cap member 28, the cap assembly 30 and the piercing member 32 can be preassembled as a unit and that unit can be applied onto a vial that has already been temporarily sealed by the retainer member 26 and the stopper 24.

Figure 4:
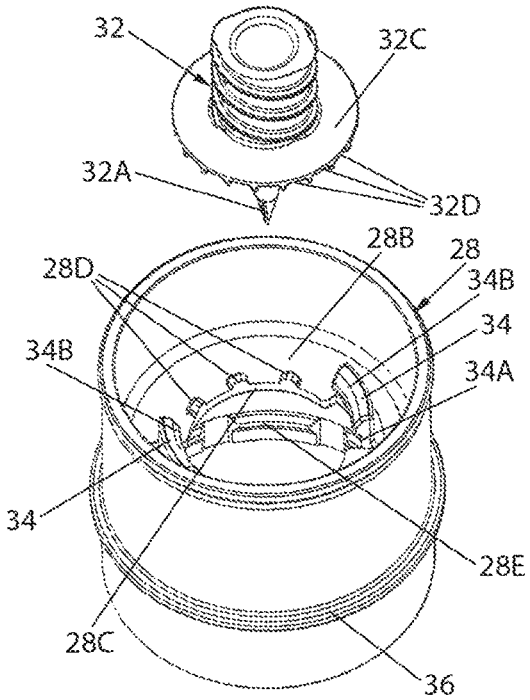
FIG. 4 is an exploded isometric view of the piercing member and the locking member shown in FIG. 3.
Figure 5:
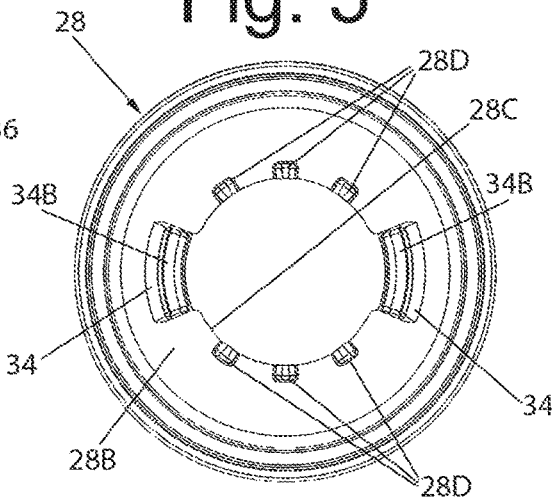
FIG. 5 is an enlarged top plan view of the locking member shown in FIGS. 2-4.

The locking member 28 is best seen in FIGS. 4-6 basically comprises a circular sidewall 28A from which a generally planar ledge 28B projects inward. The locking member 28, like each of the retainer member 26, the cap assembly 30 and the piercing member 32, can be molded as an integral unit. The center of the ledge 28B is open, i.e., in the form of a circular hole 28C. The hole 28C provides access for the piercing tip 32A of the piercing member 32 to pass therethrough and then through the hole 26C in the retainer member 26 to pierce through the underlying stopper 24.

As best seen in FIGS. 4 and 5, a plurality of protuberances or teeth 28D extend upward from the top surface of the ledge about the periphery of the hole 28C for cooperation with the recesses 32D of the flange 32C. In particular, as will be described later the recesses 32D are shaped to matingly receive the teeth 28D on the ledge 28B of the locking member to hold the piercing member in place during removal of a portion of the cap assembly 30.

As best seen in FIGS. 3 and 4 a plurality of internal lugs 28E projects inward from the inner surface of the lower end portion of the sidewall 28A. The lugs 28E are located slightly above the bottom edge of the locking member 28. The top surface of the ledge 28B includes a pair of diametrically opposed tabs 34, each of which projects upward from the ledge. The teeth 28D are equidistantly spaced about the periphery of the hole 28C between the tabs 34 as best seen in FIG. 5. Each of the tabs is undercut at 34A as best seen in FIG. 4 and each tab is slightly flexible. The top surface of each of the tabs is shaped as a cam surface 34B (FIG. 6). As will be described later, this arrangement enables the flange 32C of the piercing member 32 to slide over the cam surfaces to cause the tabs to flex outward to allow the flange to pass between the tabs and be trapped between the top surface of the ledge 28C and the undercut surfaces 34A of the tabs.

An annular ridge 36 extends about the periphery of the sidewall 28A. The ridge serves as a means which cooperates with a correspondingly shaped groove or recess in the cap assembly to hold the cap assembly in place on the locking member 28.

The locking member 28 is disposed on the top of the retainer member 26 in the same manner that the locking member of the '665 patent so that a force can be applied to it to cause it to move down with respect to the vial to a temporary sealing position. At this point the stopper 24 will be compressed and locked in place onto the neck of the vial by the inwardly projecting lugs 26E engaging the undersurface of the lip of the vial as described earlier. In order to permanently seal the vial, all that is required is to apply a further downward force onto the locking cap 28 to cause it to move to the down position shown in FIG. 6, whereupon its inwardly projecting lugs 28E provide an inwardly directed force on the fingers 26D of the retainer member 26, thereby ensuring that the vial is permanently sealed.

As mentioned above the capping system subject invention is arranged to provide ready access to the contents of the vial via the piercing member 32. To that end, the piercing member 32 is held in a retracted or up position with respect to the sealed vial by the heretofore identified cap assembly 30 until access to the contents of the vial is desired. The cap assembly is best seen in FIGS. 1-3 and 6 and basically comprises a cup-shaped hollow cap 38 and a band 40. The cap 38 includes a threaded socket 38A for releasably mounting the piercing member therein and holding it in the retracted position like shown in FIG. 6. The cap is a hollow member which includes a threaded socket 38A centered on its longitudinal axis for releasably mounting the piercing member therein and holding it in the retracted position like shown in FIG. 6. The band 40 is a ring-like structure that includes an annular recess 40A extending about its inner periphery adjacent its lower end. The recess 40A is configured to receive the heretofore identified annular ridge 36 of the locking member 28 to temporarily hold the cap assembly 30 in place on the locking member in the retracted or up state shown in FIG. 6.

The band 40 is removable (i.e., releasably secured to the cap 38) so that once the band is removed the cap 38 can be moved (e.g., pushed) from the up or retracted position shown in FIG. 6 to a down or extended position (not shown) wherein the piercing tip 32A of the piercing member has pierced through the stopper 24. To that end, as best seen in FIGS. 1, 2, 3 and 6 the band 40 is releasably secured to the bottom of the cap 38 by frangible (e.g., perforated) line 42 extending about the entire periphery of the cap. The lower edge of the band 40 is in the form of a downwardly projecting tab 44 (FIGS. 1-3). A second frangible (e.g., perforated) line 46 extends perpendicularly to the frangible line 42 from the lower edge of the band 40 to the frangible line 42 immediately beside the tab 44. Hence one can grasp and pull on the tab 44 to cause the frangible lines 46 and 42 to break, thereby removing the band 40 from the cap 38.

As best seen in FIG. 6, the top edge 28F of the sidewall 28A of the locking member is slightly bulbous and is received within a correspondingly shaped recess 38B in the inner periphery of the cap 38. The recess 38B is located at approximately the mid-height of the cap assembly 30. Accordingly, after the band 40 is removed the cap 38 is still held in the retracted position by the bulbous edge 28F received with the recess 38B such as shown in FIG. 6. However, the application of a force onto the top of the cap 38 will cause the sidewall of the cap 38 to bow slightly outward whereupon the recess 38A will release the ridge, thereby enabling the cap to be moved downward towards the retainer member to the extended position. In that position or state (not shown) the piercing member pierces the stopper 24 so that its tip 32A is within and in fluid communication with the interior 22A of the vial 22.

As mentioned earlier the piercing member 32 is held within the cap by means of its threaded portion 32B being screwed into the socket 38A. When the cap 38 is moved downward to the extended position the flange 32C of the piercing member slides over the cam surfaces at the top of the tabs 34, whereupon the tabs flex outward to allow the periphery of the flange to pass thereover and into the undercut portions of the tabs, whereupon the tabs flex back to trap the flange between them and the upper surface of the ledge 28B with the teeth 28D of the ledge 28B being received within corresponding recesses 32D of the flange. This action holds the piercing member in place so that its hollow piercing tip extends into the interior of the vial to provide access to the vial's contents. Once that action has occurred it is necessary to remove the cap 38 from the system 20 to provide access to the hollow interior of the threaded portion 32B of the piercing member so that a syringe (not shown) or some other instrument, e.g., a catheter, (not shown) can be connected to the piercing member to withdraw the contents of the vial into that syringe or other instrument through the piercing member.

The removal of the cap is achieved by unscrewing it with respect to the piercing member. The disposition of the teeth 28D of the locking member within the recesses 32D in the flange prevent the rotation of the piercing member as the cap is unscrewed from the piercing member. Thus, the cap can be unscrewed from the piercing member, while the piercing member is held stationary with respect to the locking member and hence with its piercing tip within the interior of the vial.

The hollow interior of the piercing member at the portion 32B can be in the form of a luer fitting or some other conventional connector to enable a syringe or other instrument to be connected to the piercing member. As mentioned earlier the piercing tip is a hollow pointed member. Thus, after the syringe or other instrument has been connected to the piercing member and operated the flowable contents of the vial can flow (i.e., be withdrawn) into the open end of the piercing tip, through its hollow interior and into the interior of the threaded portion 32B from whence the contents can flow into the syringe or other instrument.

It should be pointed out at this juncture that the capping system of this invention can be used in the same ways as described in the prior application. In addition, since the capping system of this invention in and of itself provides a means for gaining access to the sealed vial's contents it offers additional advantages to the pharmaceutical and medical fields.

It should also be pointed out that the capping system subject invention can be used for liquid fills, as well as freeze dried applications, allowing the closed container to leave a sterile environment with proven seal integrity and be handled in a non-classified environment. It could be made available in various finish sizes and the piercing member could be designed to fit with a variety of devices for administration.

Without further elaboration the foregoing will so fully illustrate my invention that others may, by applying current or future knowledge, adopt the same for use under various conditions of service.

I claim:

1. A cap system for a pharmaceutical vial having an interior in which a flowable material is disposed, an opening to the interior of the vial and a flanged neck surrounding the opening, the flanged neck having an undersurface, said cap system comprising:

an elastomeric stopper configured to be secured to the vial;

a retainer member comprising a sidewall and a plural resilient fingers located about a periphery of said sidewall, said retainer member being configured to be secured to the vial with said fingers of said retainer member being configured to flex over the flanged neck of the vial and then snap into engagement with the undersurface of the flanged neck of the vial;

a locking member slidably coupled to said retainer member and comprising a peripheral sidewall including inwardly projecting members, said locking member being configured to slide to a fixed position with respect to said retainer member, whereupon said inwardly projecting members of said locking member apply an inward force on said fingers of said retainer member to permanently seal said vial;

a cap member and slidable to an extended position, slidably coupled to said locking member, said cap member having a hollow interior in which a piercing member is located, said piercing member having a piercing tip, wherein when said cap member is slid to said extended position, said piercing tip of said piercing member passes through said stopper into the interior of the vial.

2. The cap system of claim 1 wherein said piercing tip is hollow and wherein said piercing member additionally comprises a connector for connecting said piercing member to a device for withdrawing at least a portion of the flowable material in the vial through said piercing member.

3. The cap system of claim 2 wherein said connector comprise a luer fitting.

4. A cap system for a pharmaceutical vial having an interior in which a flowable material is disposed, an opening to the interior of the vial and a flanged neck surrounding the opening, the flanged neck having an undersurface, said cap system comprising:

an elastomeric stopper configured to be secured to the vial;

a retainer member comprising a sidewall and a plural resilient fingers located about a periphery of said sidewall, said retainer member being configured to be secured to the vial with said fingers of said retainer member being configured to flex over the flanged neck of the vial and then snap into engagement with the undersurface of the flanged neck of the vial;

a locking member slidably coupled to said retainer member and comprising a peripheral sidewall including inwardly projecting members, said locking member being configured to slide to a fixed position with respect to said retainer member, whereupon said inwardly projecting members of said locking member apply an inward force on said fingers of said retainer member to permanently seal said vial;

a hollow cap member having a socket therein, said hollow cap member being slidably coupled to said locking member to enable said hollow cap member to be slid from a retracted position to an extended position; and a piercing member, said piercing member being releasably located in said socket and having a piercing tip, wherein when said hollow cap member is slid to said extended position said piercing tip of said piercing member passes through said stopper into the interior of the vial.

5. The cap system of claim 4 wherein said cap member comprises a portion of an assembly additionally comprising a band releasably secured to said cap member, said band being arranged to be removed from said assembly to enable said cap member to be slid from said retracted position to said extended position.

6. The cap system of claim 5 wherein said cap member and said band member are releasably secured to each other by a frangible connection.

7. The cap system of claim 6 wherein said band member comprises a pull tab to enable one to grasp said tab to break said frangible connection.

8. The cap system of claim 7 wherein said frangible connection extends about a periphery of said cap member.

9. The cap system of claim 4 wherein said cap member is arranged to be removed from said piercing member after said cap member is in said extended position leaving said piercing member in place extending into the interior of said vial.

10. The cap system of claim 9 wherein said locking member comprises an inwardly projecting ledge from which at least one of tab projects, and wherein said piercing member comprises a flange having an upper surface and a lower surface, said lower surface of said flange being arranged to be disposed on said ledge, said upper surface of said flange being arranged to be trapped under said at least one tab to hold said piecing member in place when said cap member is in said extended position.

11. The cap system of claim 10 wherein said socket includes an internally threaded portion and wherein said piercing member comprises an externally threaded portion screwed within said internally threaded portion of said socket, said cap member being arranged to be unscrewed from said piercing member after said cap member is in said extended position, whereupon said cap member can be removed from the vial leaving said piercing member in place extending into the interior of the vial.

12. The cap system of claim 11 wherein one of said ledge and said lower surface of said flange includes at least one recess the other of said ledge and said lower surface of said flange includes at least one tooth for receipt in said at least one recess to prevent rotation of said piercing member when said cap member is unscrewed therefrom.

13. The cap system of claim 11 wherein said cap member comprises a portion of an assembly additionally comprising a band releasably secured to said cap member, said band being arranged to be removed from said assembly to enable said cap member to be slid from said retracted position to said extended position.

14. The cap system of claim 13 wherein said cap member and said band member are releasably secured to each other by a frangible connection.

15. The cap system of claim 14 wherein said band member comprises a pull tab to enable one to grasp said tab to break said frangible connection.

16. The cap system of claim 15 wherein said frangible connection extends about a periphery of said cap member.

* * * * *